US006213307B1

(12) United States Patent
Stein

(10) Patent No.: US 6,213,307 B1
(45) Date of Patent: Apr. 10, 2001

(54) FLUID-BED CLEANER AND GRADES SORTER FOR PARTICLE FORM MATERIALS

(75) Inventor: Peter Stein, Col. Bello Monte (VE)

(73) Assignee: Grana Inc., New York, NY (US)

( * ) Notice: Subject to any disclaimer, the term of this patent is extended or adjusted under 35 U.S.C. 154(b) by 0 days.

(21) Appl. No.: 09/333,856

(22) Filed: Jun. 15, 1999

Related U.S. Application Data

(63) Continuation-in-part of application No. 08/559,473, filed on Nov. 15, 1995, now abandoned.

(51) Int. Cl.[7] ..... B07B 4/00

(52) U.S. Cl. ..... 209/139.1; 209/134; 209/142; 406/123; 406/197

(58) Field of Search ..... 209/133, 134, 209/135, 138, 139.1, 140, 141, 142, 143; 134/25.1; 46/86, 108, 123, 197, 198

(56) References Cited

U.S. PATENT DOCUMENTS 3,437,202 * 4/1969 Kaiser ..... 209/138 X
3,438,681 * 4/1969 Lunde ..... 209/139.1
4,127,476 * 11/1978 Iannazi ..... 209/138 X
4,931,174 * 6/1990 Lihlemann et al. ..... 209/139.1
5,366,094 * 11/1994 Stein ..... 209/139.1 X
5,727,689 * 3/1998 Anderson et al. ..... 209/139.1

FOREIGN PATENT DOCUMENTS

848093 * 7/1981 (SU) ..... 209/139.1
1743647 * 6/1992 (SU) ..... 209/139.1

* cited by examiner

*Primary Examiner*—Tuan N. Nguyen

(57) ABSTRACT

A first stage chamber has upwardly diverging walls so that an upward airstream has different air velocities at different heights in the chamber. When particles such as seeds are fed homogeneously along the chamber top length, they reach equilibrium at different heights depending on their weights and volatilities. The particles suspended and classified at different heights are conveyed by a horizontal airstream in parallel horizontal channels toward a chamber side wall, where they are removed by suction. Ribbed sections adjacent to the channels divide the chamber into deviating cascaded pathways, where the upward air velocity is homogenized and an opposite horizontal airstream conveys falling particles toward the side wall opposite to that on which the particles are removed, to thereby homogenize the spread of particles in the chamber. Light trash is removed through a convergent top section toward a cyclone. Heavy particles not suspended in the chamber are collected and removed at the chamber bottom. A second stage receives the particles removed at a sidewall of the first stage and performs a further separation by ballistically projecting the particles into one of two groups depending on the adjustable horizontal extent of the ballistic projection of the particles.

17 Claims, 8 Drawing Sheets

FIG. 1-A
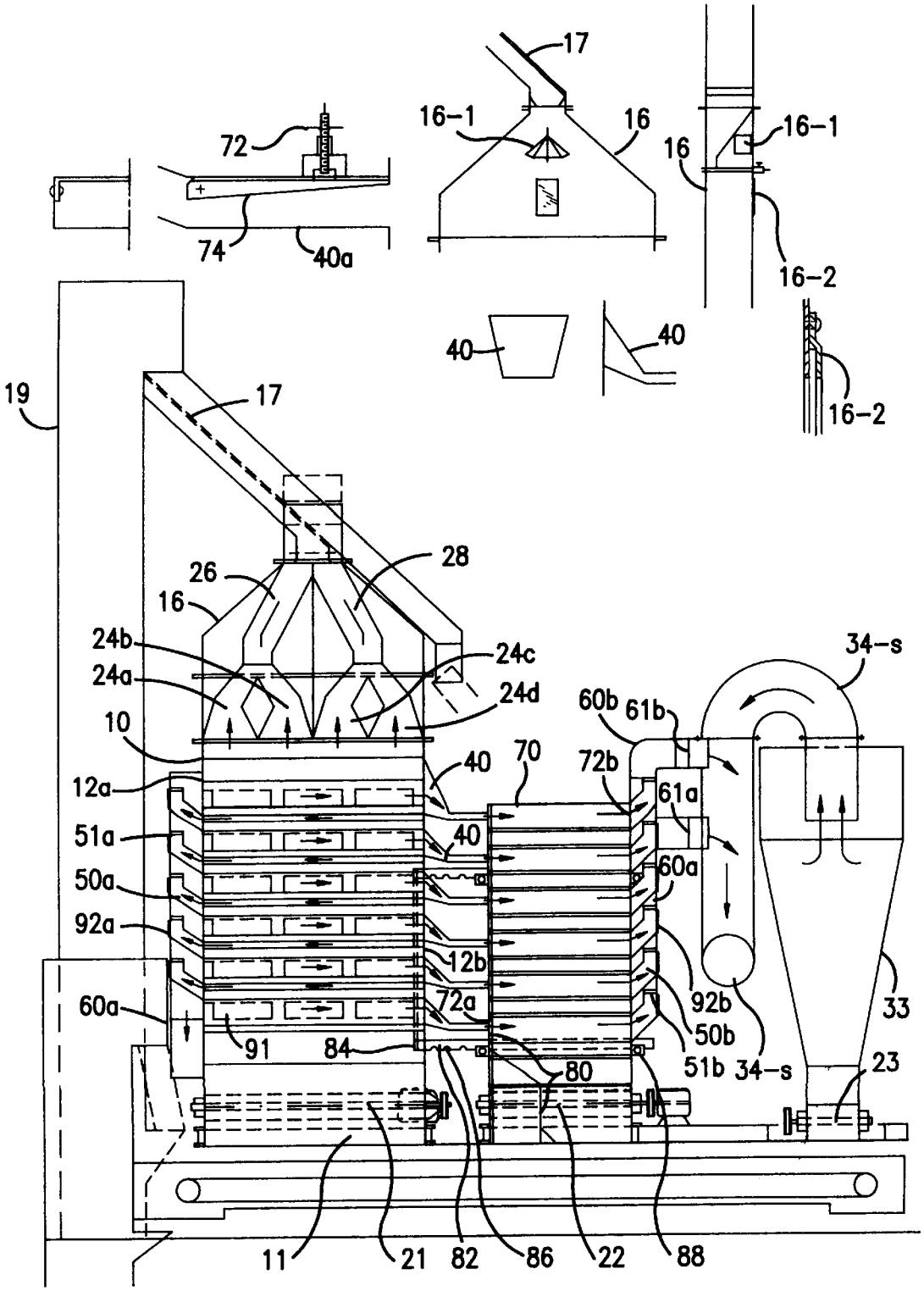

FIG. 1-B
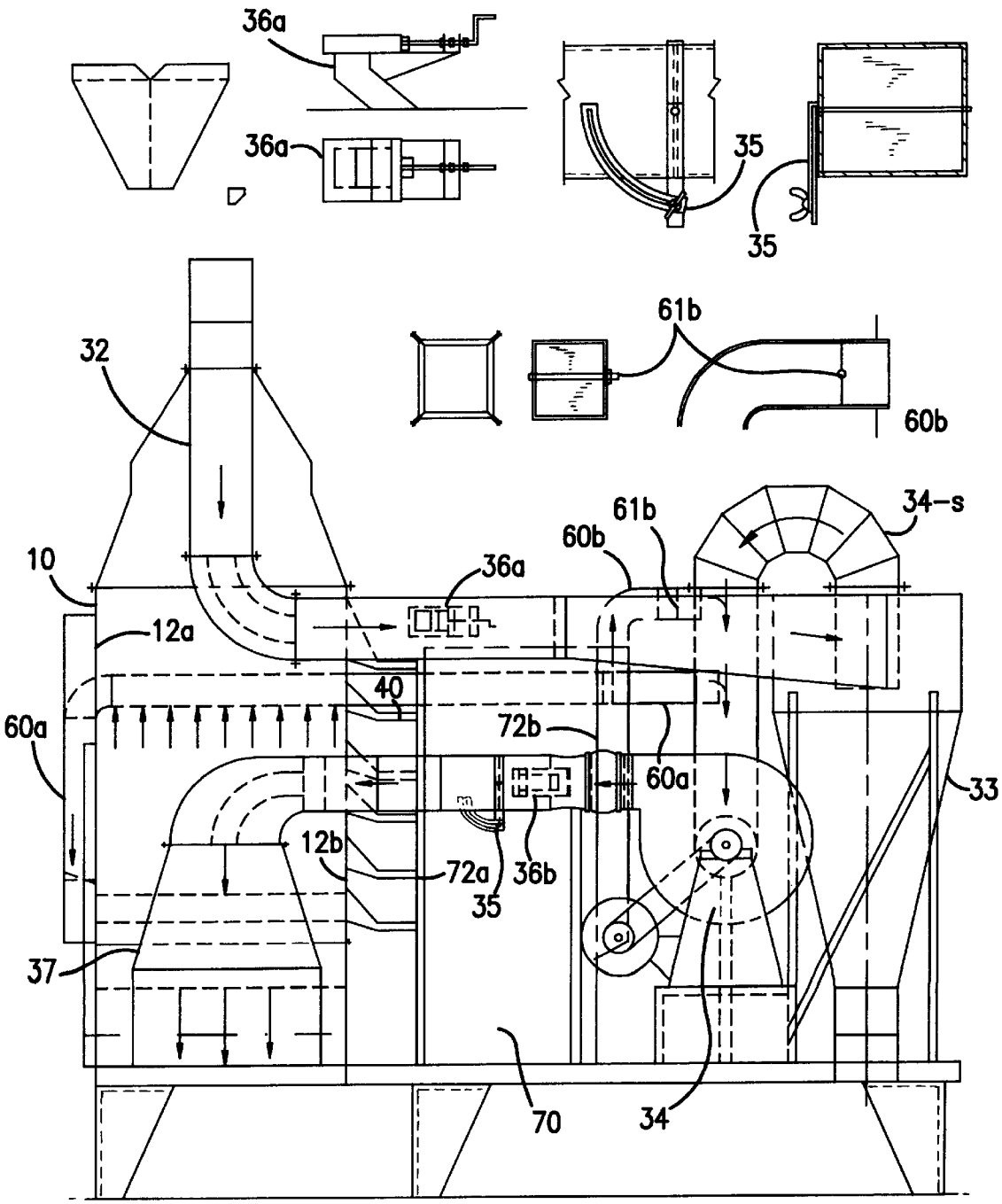

FIG. 1–C
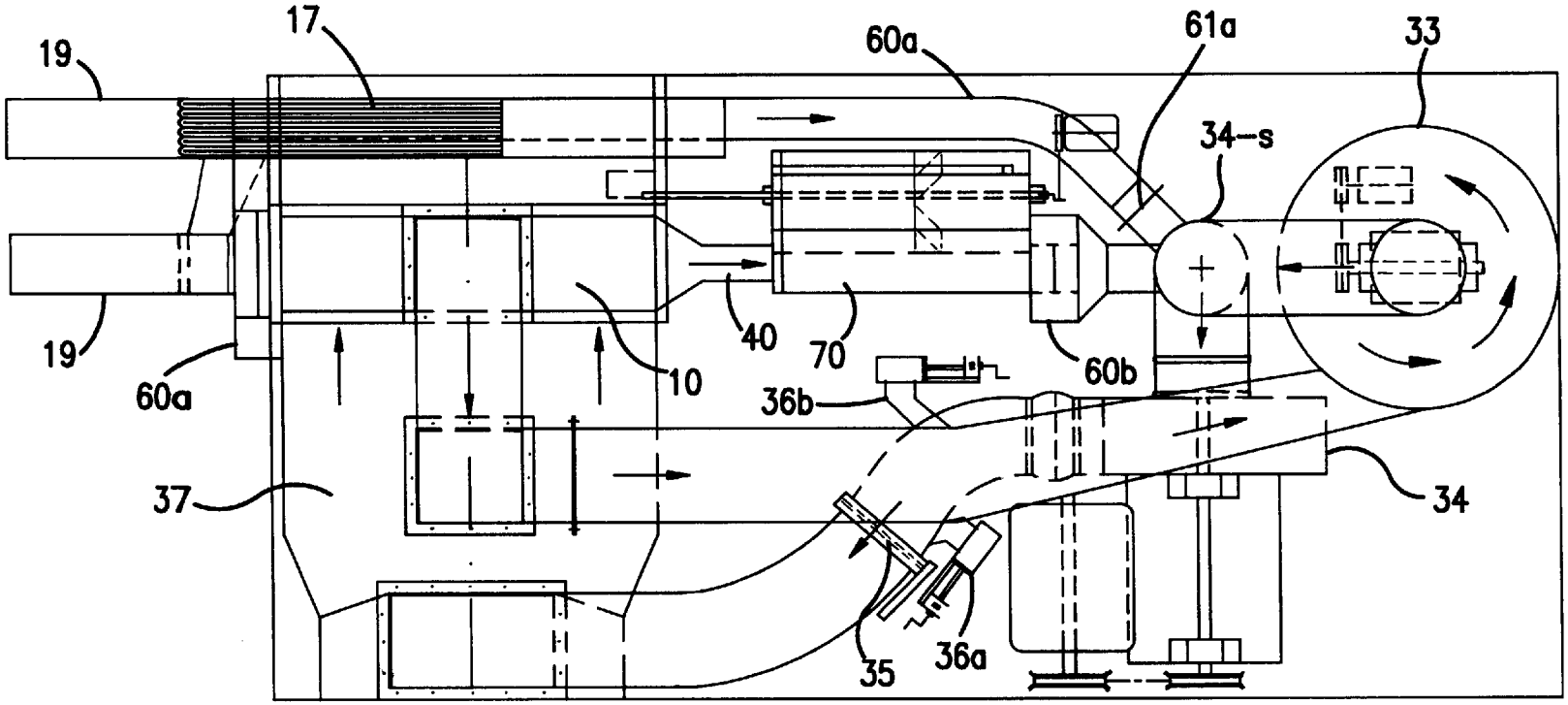

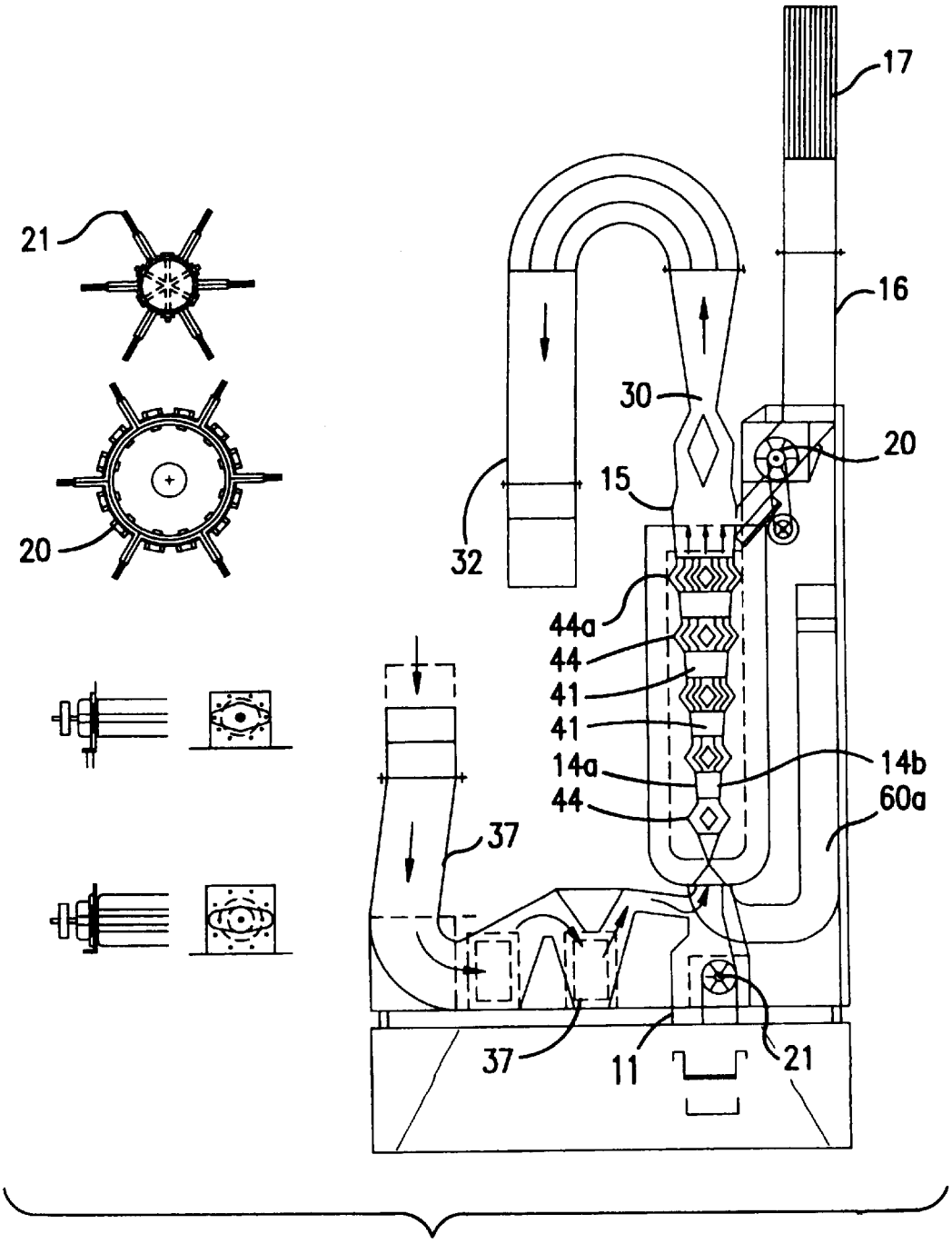
FIG. 2-A

FIG. 2-B
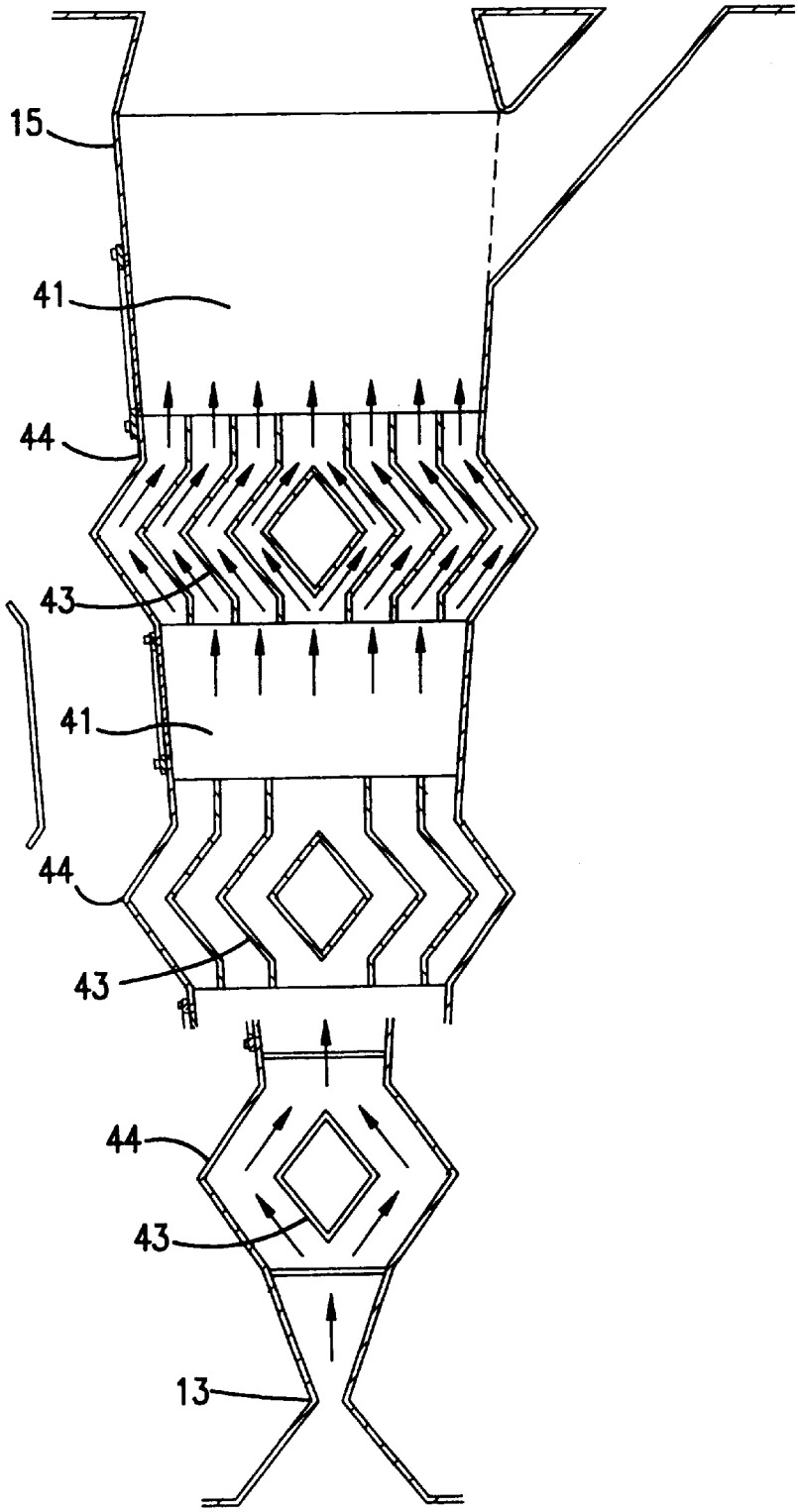

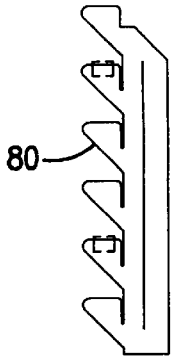
FIG. 10
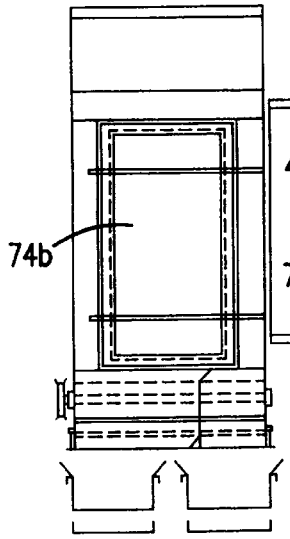
FIG. 9
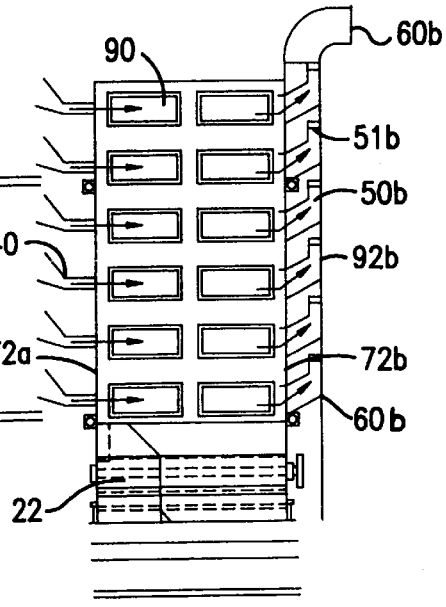
FIG. 7
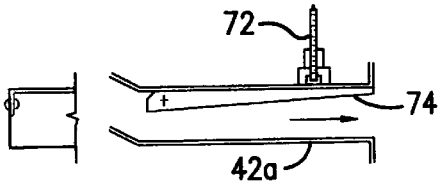
FIG. 11
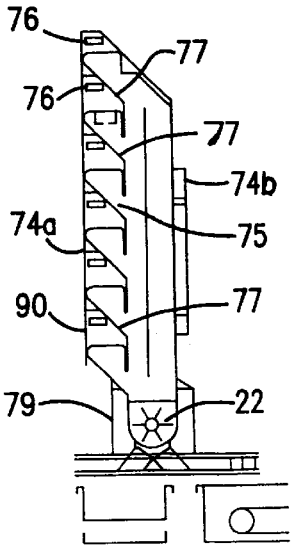
FIG. 8-A
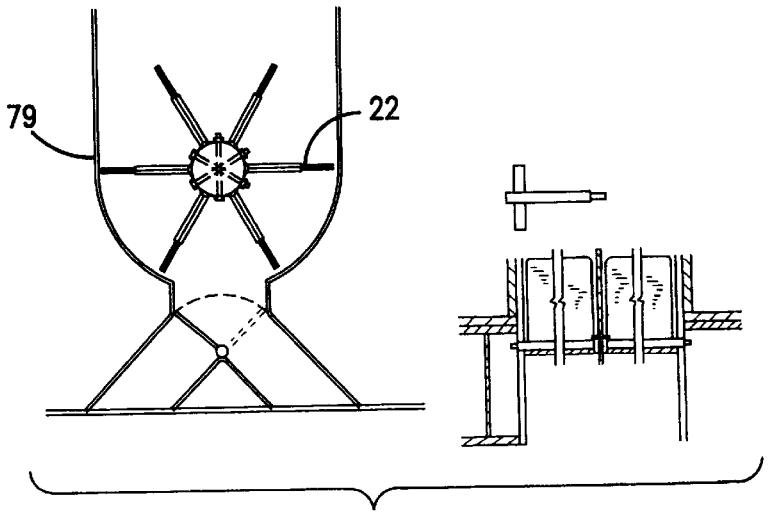
FIG. 8-B

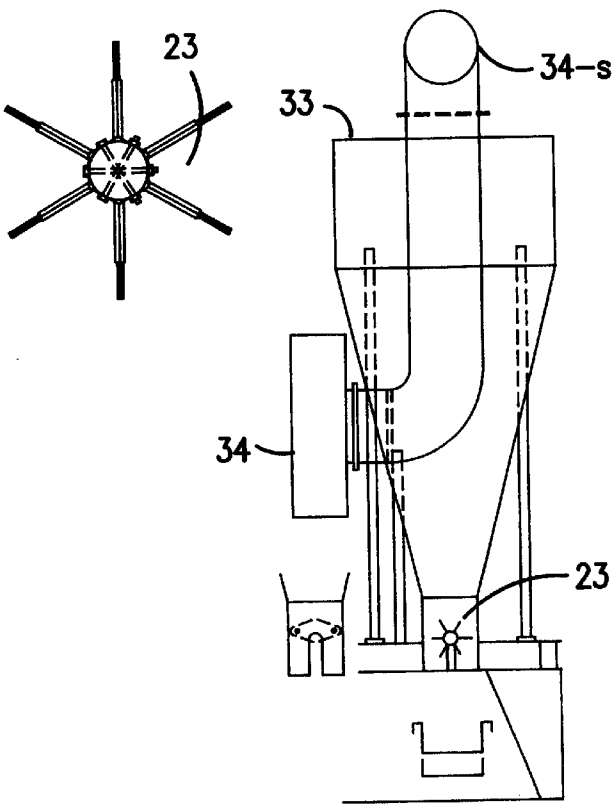
FIG. 13
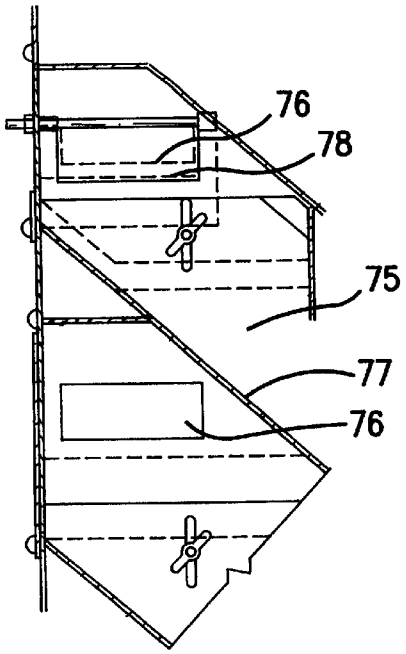
FIG. 12-A
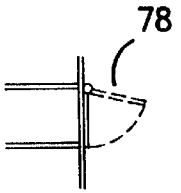
FIG. 12-B

FLUID-BED CLEANER AND GRADES SORTER FOR PARTICLE FORM MATERIALS

This application is a continuation in part of Ser. No. 08/559,473 filed Nov. 15, 1995. Abandoned.

BACKGROUND OF THE INVENTION

The starting point in the development of the present invention was a first prototype of the cleaner and classifier which is described in U.S. Pat. Nos. 5,281,278 (apparatus) and 5,366,094 (method). These patents disclose the inventor's preliminary theoretical ideas about an apparatus and a method to classify particles of different weight by creating an upward airstream for suspension of the particles in a chamber whose cross-section augments in upward direction, to thereby vary the vertical air velocity with height and suspend particles of different weight at different heights, whereby lighter particles are suspended at higher height than heavier ones. The backround of these preliminary ideas was also disclosed in U.S. Pat. Nos. 5,281,278 and 5,366,094.

The present invention is a result of the experience gained by testing such theoretical ideas through that first experimental prototype. The conclusion of the tests was that such ideas still required a considerable effort in development work before a commercially viable prototype could be built. Such development work, including the tests and several generations of blueprints, is the backround of the present invention.

It may be argued that preliminary theoretical ideas do not generally justify the cost of a patent application and that it is preferable to test the ideas experimentally before applying for a patent. Such a view makes much sense for an inventor having available facilities for tests. However, an independent inventor not having such available facilities may find it advantageous to risk the filing cost before he negotiates with a manufacturing firm an arrangement enabling him to use the facilities of the firm for his tests. Shortly after the inventor filed the application for U.S. Pat. No. 5,281,278 and well before he was granted such patent, the inventor signed in March of 1993 a cooperation agreement with Westrup A/S in Slagelsee, Denmark, a manufacturer of machines which are in several ways similar to the present invention.

Although the problem of unstable air in aspirating spaces or chambers is typical and well known to the manufacturers (see a discussion of the problem in Uhlemann's U.S. Pat. No. 4,931,174 of Jun. 5, 1990) and although aspiration chambers have been widely tested and improved over the years in view of the importance that air stability has for machine capacity, none of the cooperating parties realized to what extent such prior experience could serve to predict the unstable air which was encountered in the aspiration chamber of the first prototype when the prototype was tested with feed quality grains of wheat and barley.

The instability of air in aspirating chambers having particles spread within an upward airstream may be explained by means of a law of the physics of fluids, whereby fluids allways search the path of least resistance. Whenever there are zones within the chamber, where the density of the particles, i.e. the amount of particles per unit volume, tends to be temporarily higher than such density in other zones of the chamber, the air within the first zone will burst out toward the other zones, whereby the intensity of such outburst depends on the difference of density which originates it. When the originating difference of density within an undamped chamber is large enough, the air in the chamber may become drastically unstable with large waves whose tops swing forth and back between opposite chamber sidewalls, dragging particles along. When the originating difference of density within such undamped chamber is kept small enough, the instability is limited to a pulsation of the vertical air. If the upward air is used in an upwardly diverging chamber to classify particles by suspending particles of different weight at different heights, it is obvious that the pulsation of the vertical air will impair the classifying sharpness. When the originating difference of density is increased, for instance by increasing the feeding rate of particles, the intensity of the pulsation augments up to a critical point (or critical feeding rate) where formation of large waves starts.

The above considerations suggest that a uniform or homogeneous distribution of the particles throughout the chamber is the key to a stable chamber.

In accord to the first blueprints delivered to the manufacturer, the chamber of the first prototype had two parallel vertical side walls, the left and right walls, and two upwardly diverging side walls, the front and back walls. Means were available to create an upward airstream to suspend particles and a horizontal conveyor airstream to direct the suspended, classified particles toward the right wall, wherein the particles were collected and removed by suction through eight outlet-collectors arranged vertically along that wall. The particles were fed by a pipe at the bottom of the left wall. If a curve is drawn diagonally between such bottom of the left sidewall and the top of the right sidewall as a hypothetical travel path of the lightest particles suspended and classified within the chamber, it is obvious that the combined upward and rightward airstreams will concentrate the particles primarily in the zone below and on the right side of that curve. To put it another way, the chamber of that first prototype was structurally unstable because it produced a higher concentration or density of particles in one zone of the chamber.

The test results confirmed that the first prototype could only be operated within a reasonable limit of instability at low feeding rates of particles and that, when operated at such rates, the classifying sharpness was impaired by the pulsation of the upward air. When the chamber was operated in drastical instability at high feeding rates, the test results showed further that the amplitude and frequency of the stormy waves swinging forth and back between the sidewalls augmented as the feeding rate of particles was increased. The cleaning performance, i.e. the removal through the convergent top section of trash lighter and more volatile than the particles suspended at the top of the chamber, was satisfactory within above-discussed reasonable limits of instability and no wheat or barley particles were found in the cyclone trash.

There is no such structural instability in the classical chambers built by manufacturers of air-screening machines because these chambers only have an upward airstream lifting the particles (but no destabilizing rightward airstream). Achieving stability is therefore primarily a matter of feeding the chamber homogeneously by means of an airlocking wheel along the entire length of the chamber, thereby creating a reasonably uniform spread of the particles throughout the chamber. When these chambers are fed in said manner, the air will remain stable at relatively high feeding rates and up to a critical saturation density of the particles (or critical feeding rate) where instability becomes visible. Some degree of pulsation in the vertical air is not a major problem since the particles are not suspended and classified within the chamber, but only lifted upwardly.

The test results led to the conclusion that the first prototype could be stabilized only by providing it with following means: (1) means to strongly dampen the upward air in the chamber, (2) means to feed the particles uniformly along the entire length of the chamber; (3) means to compensate the rightward concentration of particles caused by the rightward conveyor airstream by an opposite horizontal airstream spreading the particles in chamber length toward the left side of the chamber, to thereby spread more uniformly the particles throughout the chamber; (4) means to spread also the particles in chamber width, particularly in view of the divergent front and back walls of the chamber. It may at this point seem obvious that such a combination of means was likely to solve the problem of instability, but it took over two years to design a solution which looked feasible enough.

It will be evident to those skilled in preparing patent applications that the adoption of said additional means was likely to transform the original method and apparatus into an essentially different cleaning and classifying method and apparatus requiring therefore essentially different patent claims.

The development work toward a second prototype comprised also the authorized adoption of a few tested solutions used in the machines of the danish manufacturer, in particular the feeding of particles through an airlocking wheel supplied by a vertical hopper whose level of particle material is kept substantially constant along the entire chamber length by means of a spreading device at the top inlet of the hopper; and the feeding of air into the chamber by means of an inlet casing which forces several deviations and collisions of the air, to thereby homogenize in length the vertical velocity of the air entering the chamber.

All that development effort and cost are of course only justified if the stabilized and improved second prototype proves to be potentially superior to other cleaning and classifying methods and apparatii available in the market. The inventor believes that the advantage of his method and apparatus lies essentially in two competitive ratios: (1) the ratio of cost of acquisition to the performing capacity of the classifier and (2) the ratio of cost of maintenance (as accumulated over the amortizing years) to the performing capacity of the classifier. Some features expected from the first commercial version are listed below:

(1) Performs similarly to a hooded gravity separator. Removal of dust and light/volatile material superior to that of a hooded gravity separator. Classifying sharpness similar or inferior to that of a gravity separator, but probably sufficient for users interested only or primarily in the separation of stones and of excessively large or excessively small particles from the middlings.
(2) Simplicity and low cost of manufacturing.
(3) Low cost of maintenance, particularly no eccentric wheel to cause wear/tear.
(4) Less air volume than gravity separators, less expense in bag filters.
(5) Absence of the meshes of gravity separators and flexible service of the different types of particles (seeds) by adjusting the upward air volume.
(6) Efficient removal of dust and light/volatile trash, no particles (seeds) wasted in the trash.
(7) Removal of dust and light trash under slight vacuum, no outleaks of dust.
(8) Ready incorporation of cyclone and air recirculation in the unit.
(9) Power required (standard unit): about 15 HP (including air recirculation), i.e. energy savings.
(10) Limited space required to install.
(11) Simple to install.
(12) Full shipment possible in a 20 ft container.

SUMMARY OF THE INVENTION

Before summarizing the invention, it is convenient to define some terms used in this text. The terms "volatility" and "volitation" of a particle are herein mutually substitutive and understood as the particle's ability to become suspended at some height by any air velocity within the range of vertical upward velocities available in an upwardly diverging chamber like that used in this invention; whereby such ability to become suspended is expressed in terms of said height if the characteristic terminal velocity, at which the particle becomes suspended in a laboratory test, is included in said range of upward air velocities. The adjectives "volatile" and "volitant" are therefore also understood mutually substitutive. A particle's terminal velocity depends generally on its characteristic weight (volume), specific weight and shape (i.e. the shape's air resisting force). A particle is herein said to be "more volatile" than the particles suspended in the chamber if such particle's terminal velocity is less than said range's upward velocities. If a particle's terminal velocity is larger than said range's upward velocities, such particle is herein said "less volatile" than the particles suspended in the chamber. The terms "horizontal air stream" or "horizontal air velocity" used in connection with said upwardly diverging chamber are understood respectively as that air stream's or air velocity's horizontal component, whereby such air stream or air velocity has also a vertical component. Similarly, the terms "vertical air stream" or "upward air velocity" are understood respectively as vertical component of such air stream or air velocity. Both components are generally understood to be adjustable. The expression "fluid bed" is used herein in connection with the suspending ability of said range of upward velocities in the upward diverging chamber. Since the chamber's cross-section decreases downwardly, the upward air velocities and the air forces of such fluid bed are accordingly understood to augment downwards. It is convenient to clarify that dictionaries of physics often define the term "terminal velocity" as the maximum velocity reached by a particle moving or falling through a fluid at rest; since said chamber's fluid is upwardly moving air, wherein most falling particles are decelerating, the above first definition is a more appropriate one. Since the term "plurality" is normally understood to be at least two elements, the expression "plurality of at least one" is utilized herein for a group consisting regularly of at least two elements and at least one element in particular cases.

The present invention relates to improvements in cleaning and classifying solid particle form material.

According to one form of the invention, an apparatus is provided for cleaning and classifying solid particles having different weights. Such apparatus comprises (1) a vertical chamber having sidewalls and a cross-sectional area generally increasing in the upward direction; (2) means for introducing particles of different weights into the chamber; (3) means for creating in the chamber a vertically upward suspension airstream whose velocity varies substantially continuously with height, to thereby classify particles of different weight and volatilities at different heights, whereby the lighter and more volatile particles are suspended at a height higher than the heavier and less volatile particles; (4) a top section provided with outlet means and connected to the top of the vertical chamber to collect and remove particles lighter and more volatile than the particles suspended at the top of the vertical chamber; (5) a plurality of at least one channel spaced vertically within the chamber, wherein the particles within a range of similar weights and volatilities are suspended and conveyed horizontally toward channel-outlet means arranged vertically along one sidewall of the chamber for removing by suction the suspended, classified particles; (6) a plurality of at least one ribbed section spaced vertically within the chamber and located adjacently to the channels, wherein a plurality of at least one deviating rib divides each such section in a plurality of pathways and deviates the upward air, to thereby homogenize the vertical velocity horizontally throughout adjacent channels, wherein the air velocity in each pathway has a substantial non-vertical component such that the air resistance to the gravity fall of particles is insufficient, wherein particles falling through the sections are conveyed horizontally toward air-extraction means arranged vertically at one end of the ribbed sections along the sidewall opposite to the chamber sidewall on which the channel-outlet means are positioned, to thereby spread the particles more uniformly horizontally in the direction of length throughout the chamber, whereby at a specified height length is the distance between the sidewall on which the air-extraction means are positioned and the opposite sidewall on which the channel-outlet means are located and width is the distance between the other opposite sidewalls; (7) means to spread the particles horizontally in the direction of width; (8) means for creating a horizontal conveyor airstream to direct the particles suspended in the channels toward the respective channel-outlet means on one chamber sidewall; (9) means for creating a horizontal conveyor airstream of opposite direction to direct the particles falling through the ribbed sections toward the respective air-extraction means on the sidewall opposite to the chamber sidewall on which the channel-outlets means are positioned; (10) means for observation of the airstreams, the streams of particles and the process in general by an operator or by a process controlling device; means for adjusting the streams and the process in general by an operator or by a process controlling device; and (11) means to drive the apparatus.

According to another aspect of the invention, the method (of an apparatus) is provided for cleaning and classifying solid particles having different weights. Such method comprises (1) introducing particles of different weights into a vertical chamber, whereby said chamber has sidewalls and a cross-sectional area generally increasing in the upward direction; (2) creating in the chamber a vertically upward airstream whose velocity varies substantially continuously with height, to thereby suspend the particles having different weights and volatilities at different respective vertical heights, whereby the lighter and more volatile particles are suspended at a height higher than the heavier and less volatile particles, whereby said chamber has a top section provided with outlet means and connected to the top of the vertical chamber for collecting and removing particles lighter and more volatile than the particles suspended at the top of the vertical chamber; (3) creating a horizontal conveyor airstream in a plurality of at least one channel spaced vertically within the chamber, wherein particles within a range of similar weights and volatilities are suspended, to thereby convey such suspended, classified particles toward channel-outlet means arranged vertically along one sidewall of the chamber and thereat remove the particles by suction; (4) creating an opposite horizontal conveyor airstream in a plurality of at least one ribbed section spaced vertically within the chamber and located adjacently to the channels to convey horizontally the particles falling through the ribbed sections toward air-extraction means arranged vertically at one end of the ribbed sections along the sidewall opposite to the chamber sidewall on which the channel-outlet means are positioned, to thereby spread the particles more uniformly in the direction of length throughout the chamber, whereby a plurality of at least one deviating rib divides each section in a plurality of pathways and deviates the upward air, to thereby homogenize the vertical velocity horizontally throughout the adjacent channels, whereby the air velocity in each pathway has a substantial non-vertical component such that the air resistance to the gravity fall of the particles is insufficient, whereby at a specified height length is the distance between the sidewall on which the air-extraction means are positioned and the opposite sidewall on which the channel-outlet means are located and width is the distance between the other opposite sidewalls; (5) spreading the particles horizontally in the direction of width; (6) having means being used by an operator or by a process controlling device to observe the airstreams, the streams of particles and the process in general; (7) having means being used by an operator or by a process controlling device to adjust the streams and the process in general; (8) and having means being used to drive the unit.

The invention will now be described in connection with a certain preferred embodiment with reference to the following illustrative figures so that it may be more fully understood.

With specific reference now to the figures in detail, it is stressed that the particulars shown are by the way of example and for purposes of illustrative discussion of a preferred embodiment of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the invention may be embodied in practice.

BRIEF DESCRIPTION OF THE DRAWINGS

FIG. 1-A is a front elevational view, in partial cross-section of the cleaner and classifier according to the invention, showing on the left the first stage (or chamber), the chamber top section, the chamber bottom section and an elevator for introducing particles; on the middle the second stage (or chamber); on the right the trash cyclone and details on the top.

FIG. 1-B is a front elevational view (no cross-section) of the cleaner and classifier according to the invention, showing on the left side the first stage (or chamber), the chamber inlet casing, the chamber top section and the outlet means of the top section; on the middle the pipe connecting said outlet means of the top section to the trash cyclone and the discharge pipe of the fan connecting the fan and the inlet casing of the first stage; on the right side the cyclone, the fan and the suction pipe of the fan connecting the cyclone to the fan; and details on the top.

FIG. 1-C is a top view of the cleaner and classifier according to the invention.

FIG. 2-A is a side elevational view, in partial cross-section, of the first stage of the apparatus in FIG. 1, showing the channels and the ribbed sections.

FIG. 2-B is a detail view of FIG. 2-A.

FIG. 7 is a front elevational view of the second stage of the apparatus of FIG. 1-A.

FIG. 8-A is a side elevational view, in cross-section of the second stage of the apparatus in FIG. 1-A.

FIG. 8-B is a detail view of FIG. 8-A showing the bottom space of the second stage.

FIG. 9 is a back elevational view of the second stage of the apparatus of FIG. 1, showing the access door.

FIG. 10 is an elevational view of the sliding vertical divider partition in isolation.

FIG. 11 is a cross-sectional view of a cannon connecting the first stage to the second stage, for ballistically projecting particles into the second stage.

FIG. 12A is a side-elevational view, in cross-section of the exits of two cannons of FIG. 11, having outlet openings into the second stage.

FIG. 12B is a front-elevational view, in cross-section of the cannon exits, showing a pivoting gate.

FIG. 13 is a side elevational view of the cyclone, the suction pipe of the fan and the fan.

DESCRIPTION OF THE PREFERRED EMBODIMENT

Figure 5:
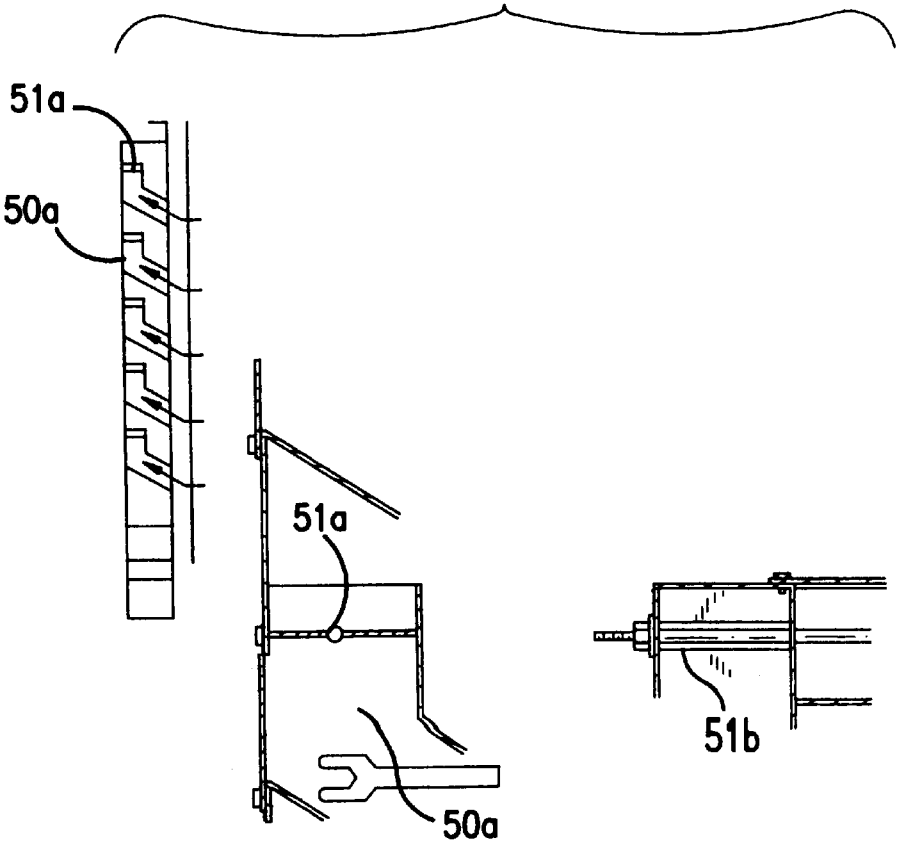
FIG. 5 is a front elevational view, in cross section of the air-extractions arranged vertically along the left wall of the first stage.

While the preferred embodiment may be described using seeds or grains as particles, the particles could be any particle whose floating capacity in a fluid bed depends on three independent variables: (1) its weight (or its volume if the particle form material has a substantially constant specific weight); (2) its shape as air resistance caused by such shape; and (3) its specific weight (or its density), whereby shape and specific weight are firstly assumed substantially constant for any specific type of particles cleaned and classified in the apparatus.

As shown in FIG. 1-A, which is a front elevational view in partial cross-section, the classifier and cleaner comprises a first vertical chamber 10 having vertical parallel sidewalls 12*a* and 12*b*, and as shown in FIG. 2-A, generally upwardly diverging front and back sidewalls 14*a* and 14*b* respectively. The four sidewalls together define a cross-section which generally increases in upward direction. The cross-section at the top 15 of the chamber is about ten times that at the bottom of the chamber 13. Such ratio of ten to one will encompass a large spectrum in particle size. Of course, the ratio may be made larger or smaller to increase or decrease the scope or range of particle weights which may be processed in the apparatus.

As shown in FIG. 2-A at the top of the chamber is an inlet means for feeding particle material into the chamber 10. Such means comprise a horizontal airlocking wheel 20 for homogeneously feeding the particles along substantially the entire top length of the chamber. The wheel is supplied by a vertical hopper 16 located on top and adjacently to the wheel along substantially the entire length of the wheel. The hopper is fed by a bucket elevator 19 through a precleaning screen 17 and a device 16-1 (see FIG. 1-A) to spread the falling particles horizontally within the hopper. A window 16-2 on a sidewall of the hopper permits observation of the level of particle material within the hopper.

Disposed at the top 15 of the chamber is a top converging section comprising four sub-sections 24*a*, 24*b*, 24*c* and 24*d*. The two leftmost subsections 24*a* and 24*b* are connected by a left union 26 and the two rightmost subsections 24*c* and 24*d* are connected by a right union 28. The two left subsections and union are symmetrical to the two right subsections and union. A further Y-coupling 30 connects the left union 26 and the right union 28 and communicates with an outlet pipe 32. The outlet pipe 32 is connected to a trash cyclone 33; and the cyclone outlet is connected through a fan 34, a damper 35 (see FIG. 1B) and a chamber inlet casing 37 to the bottom 13 of the chamber, to thereby recycle into the chamber most of the air cleaned in the cyclone. Fresh air is admitted into the circuit through inlet valve 36*a* and the excess air is removed through outlet valve 36*b* (see FIG. 1B). The suction fan 34, when the damper 35 is at least partially open, creates an upward airstream in the chamber which suspends the particle material according to weight at different heights. This is because the shape of the chamber 10, which has generally upwardly diverging walls 14*a* and 14*b*, results in higher air velocities at the bottom of the chamber than at the top.

Means are provided for creating a horizontal conveyor stream which drives the classified particles floating within horizontal channels 41 toward the right sidewall 12*b* of the chamber 10 as shown in FIG. 1-A. Arranged vertically on the right sidewall 12*b* in FIG. 1 is a plurality, in this case 6, of channel-outlets (or collectors) 40 which receive and collect the particle material from the respective channels at different heights. Means are also provided to regulate the horizontal conveyor airstream.

As shown in FIGS. 2-A and 2-B , the first chamber 10 has a plurality of ribbed sections 44 located vertically between adjacent channels and dividing the chamber horizontally into separate and parallel air pathways by means of thin parallel zigzag ribs 43. The zigzag ribs 43 deviate the upward air flowing into the ribbed sections and are at a distance of about one inch from each other, to thereby allow relatively heavy particles which do not become suspended in the chamber to fall through the ribbed sections. The top ribbed section 44*a* comprises eight separate pathways, and the number of pathways for each ribbed section generally decreases as one goes vertically down the chamber, with the bottom ribbed section having two separate pathways. For each ribbed section, the cross-sectional area at its top is substantially equal to the cross-sectional area at its bottom. The ribbed section pathways deviate from the vertical direction and provide an airflow path having a substantial non-vertical directional component. The arrangement of successive deviations and collisions of the upward air flowing into the sections serves to improve the horizontal homogeneity of the vertical airflow in the chamber 10, particularly in the adjacent channels 41. To put it another way, the ribbed section will enable the adjacent channels to do a sharper classification.

The ribs deviate also the vertical force of air resistance which acts against the vertical weight of the particles. The deviated (non-vertical) air resistance within the parallel ribs has a smaller vertical component to sustain the weight of particles.

Consequently, due to their weight, particles that cannot be retained floating on top of the ribs will fall through the ribs. No particles are intended to float (or be suspended) within the ribs, because as soon as they enter the top of a ribbed section they start to successively fall and bounce until they reach the bottom of that ribbed section at the top of the next unribbed, diverging portion of an adjacent channel 41 below that section. At that point they will be either suspended in that channel or they will continue to fall downward till they reach a channel where their weight is no longer able to overcome the resistance of the upward flow of air.

Figure 4:
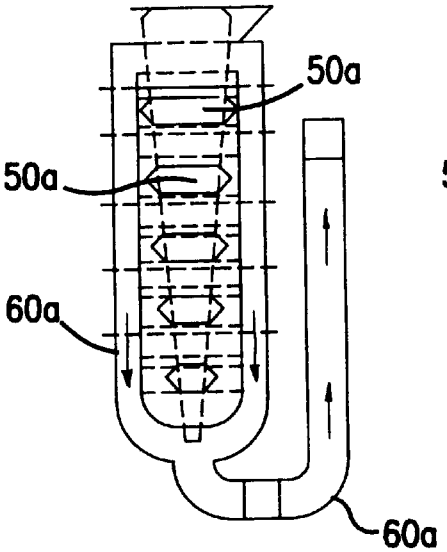
FIG. 4 is a side elevational view of the inside face of the left side wall of the first stage, on which the air extractions are positioned.
Figure 6:
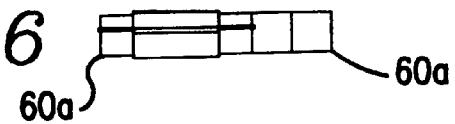
FIG. 6 is a top view of of FIG. 4.
Figure 3:
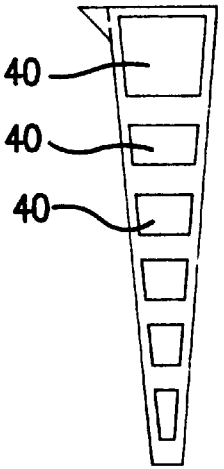
FIG. 3 is a side elevational view of the inside face of the right side wall of the first stage, on which the outlet-collectors are arranged vertically.

The apparatus of FIG. 1-A, in particular the first chamber, further has means for creating an opposite horizontal airstream within the ribbed sections, to thereby spread the particles horizontally toward the left chamber sidewall 12*a* throughout this chamber, including the lower regions thereof. The purpose of such leftward spread is to compensate for the rightward concentration of particles which results from conveying the suspended, classified particles rightwards toward the opposite sidewall 12*b*. As shown in FIGS. 4, 5 and 6, the chamber has an air extraction duct 60*a* which extracts air through openings 50*a* arranged vertically at the left end of the ribbed sections along the sidewall 12*a* of the chamber 10 at heights which differ from the heights of the channel-outlets (or collectors) 40 arranged vertically at the right end of the channels along the opposite chamber sidewall 12*b*.

Consequently there are within the chamber two opposite horizontal airstreams: one airstream within the channels which conveys the suspended, classified particles rightward toward the outlet-collectors 40 and one airstream within the ribbed sections which conveys the particles falling and bouncing through the sections in the opposite leftward direction toward the openings 50*a* of the air extractions, to thereby spread more uniformly horizontally the particles throughout the chamber.

Uniformity in the distribution of particles throughout the chamber is an important condition for the stability of the air therein. Extraction of particles at the openings 50*a* is rendered difficult because the particles fall through the ribs, and because of the adverse upward inclination at the chamber left side (see FIG. 5). The air and the suspended, classified particles are extracted through the right side through the six collectors 40 and six cannons 40*a* (see FIG. 1-A) into a second ballistic chamber where the air further flows rightward in six adjacent and parallel channels 75 (see FIG. 7 and FIG. 8-A) separated by inclined inner walls 77 towards the air-extraction openings 50*b* and the air-extraction duct 60*b*.

Both air-extraction ducts 60*a* and 60*b* are connected to the suction pipe 34*s* of the fan (see FIG. 1-A) and the rates of air-extraction in these ducts are regulated by means of the dampers 61*a* and 61*b* at the connections of the ducts with the pipe 34*s*.

The extraction air rate on the chamber left side must be large enough to secure an homogenous distribution or spread of the particles throughout the chamber. An enhanced air stability in the chamber will result in a better classifying sharpness and a higher capacity for the classifier. The extraction air rate on the chamber right side, particularly its ratio to the air rate extracted on the left side, must not exceed a critical valuer where the air stability in the chamber could be threatened in spite of the (wave-) damping effect provided by the ribbed sections. It is also possible to regulate the rates of the individual airstreams in the channels by adjusting the angular position of the rotating flaps 51*a* and 51*b* in their respective air-extraction openings 50*a* and 50*b*.

The chamber 10 further includes air-extraction means (not shown) arranged below and adjacently to the airlocking feeder wheel 20 along substantially the whole length of the front and back walls 14*a* and 14*b*, to thereby spread the particles horizontally in chamber width, whereby the width at a specified height is the distance between said diverging walls 14*a* and 14*b*.

The rate of the upward airstream in the chamber must be adjusted to the specific type of particles which are being processed in the chamber, such adjustment being by means of the damper 35. For instance the air rate required to process peanuts will be considerably greater than the rate required for sesame seeds.

The chamber 10 in FIG. 1-A has windows 91 on its front sidewall 14*a* and 92*a* on the sidewall 12*a*, wherewith an operator can observe the different streams of air, the streams of particles within the air and the classifying process in general and adjust the streams in order to obtain the best classification in the chamber.

Particles lighter than the particles suspended in the top channel of the chamber are removed and conveyed through the top converging section 24 *a, b, c, d* and the outlet pipe 32 and conveyed toward the trash cyclone 33, where the particles are separated from the flowing air and removed at the cyclone bottom by means of an airlocking wheel 23 (see FIG. 13), to thereby recycle most of the cleaned air back into the chamber.

The vertical chamber 10 of FIG. 1-A further comprises a bottom section 11 provided with outlet means and connected to the bottom of the chamber (see also FIG. 2-A), to collect relatively heavy particles which do not become suspended in the vertical airstream. The outlet means in the preferred embodiment comprises a horizontal airlocking wheel 21 along substantially the entire length of the chamber.

The second chamber 70 provides a classification by ballistic projection of the particles outputted by the first chamber 10.

Such second chamber 70 is connected to the first chamber 10 by the channel-outlets or collectors 40 and the ballistic cannons 40*a*. A more detailed view of the ballistic cannons is shown in FIG. 11. Here the cross-section of the cannon portion may be adjusted by a screw mechanism 72, which will pivot plate 74 to reduce the end opening at the gate 76 (see FIGS. 8-A and 12-A). The smaller the end opening, the faster the particles will be ballistically projected into the second chamber. At its exit the cannon is provided with a pivoting flap 78 as shown in FIGS. 12A and 12B. The position of this flap can be adjusted to allow the full extent of the horizontal projection of a particle or to limit it by deviating the stream of particles downward. Such flaps are particularly useful for the uppermost and bottommost cannon exits where the lightest and heaviest particles respectively are being outputted from the first chamber.

FIGS. 8-A and 8-B show the second chamber or second stage of the apparatus from a side-elevational view, in cross-section. These view show the chamber gates 76, six in number and arranged vertically along the left chamber wall, through which the particles enter the chamber.

A divider plate or partition 80, shown in isolation in the configuration in FIG. 10, provides a respective vertical rampwall for the particles exiting each of the six cannons. The divider plate or partition 80 is shown at position I in FIG. 1-A where virtually all the particles ballistically projected from this gates will project horizontally to the right side of the partition. The divider plate can be slid sideways to other positions where, depending on the extent of the projections and the adjustment of the pivoting flap 78, it provides a wall to divide the projected particles in a group of grade 2 or grade B, which fall to the left side of the plate, and a group of grade 1 or grade A, which project beyond the plate. A rack 82 with handle 84 connects to the plate 80 and enables movement of the plate by hand from outside the chamber, to a number of different positions, including some positions where notches 86 align with pegs 88 (see FIG. 1-A)

By watching through the windows 90 of the front sidewall 74*a* (see FIG. 8-A) and 92*b* of the sidewall 72*b* (see FIG. 7), one can observe the classification process and make adjustments, including adjusting the cross-sectional area of the cannons 40*a* at the gates 76, the angles of the pivoting flaps 78, the opening of the damper 61*b* or moving the plate or partition 80. FIG. 9 is a back view showing an access door 74*b* to introduce or remove sampling boxes which are placed within the ballistic channels to observe their outputs.

The inclined inner walls or plates 77 in FIG. 8-A are spaced vertically within the ballistic chamber 70 and are located adjacently to the gates or cannon exits 76, dividing the chamber into a plurality of ballistic channels 75, in this case six. The plates extend along substantially the entire length of the chamber and have a sufficiently steep slope to allow the landing particles to fall into the chamber bottom space 79, wherein that particles of the two segregated grades are collected and removed by means of a horizontal bottom wheel 22 (see FIG. 8-B).

Adjustment and operation:

The adjustment of the invention and its sporadic supervision during operation are facilitated by the good visibility of the processes through the windows of the first and second chambers.

The adjustment of the first chamber includes:

(1) Adjusting the speed of the top wheel 20 for the desired feeding rate of the particle form material to be processed, (2) Adjusting the flow rate of the upward vertical air in the chamber by means of the damper 35 or by varying the speed of the fan 34 to a point, where the full weight- (or size-) range of the particles is visibly suspended between the bottom- and top cross-sections of the first chamber, (3) Adjusting the valve 61*a* to a point, where the particles are visibly spread throughout the first chamber; if necessary, the individual valves 51*a* may also be used for that purpose, (4) Adjusting the valve 61*b* to a point, where the particles suspended in the channels are visibly and abundantly conveyed toward the right side wall and removed thereat by suction; if necessary, the individual valves 51*b* in the ballistic chamber may also be used for that purpose.

The adjustment of the second (ballistic) chamber comprises:

(1) Selecting the distance of the vertical divider plate 80 by means of the handle 84 in the rack 82, (2) Adjusting the cross-sections of the inlet-cannons by means of screw 72 and pivoting plate 74 to a point, where all particles are firstly projected beyond the vertical divider plate 80, (3) Adjusting the pivoting flaps 78 of selected inlet cannons, whose output is of an inferior grade, to deviate their streams of projected particles downward and thereby limit the extent of such projections to a distance less than the vertical divider plate (the selected inlets are normally the top and bottom ones), (4) Adjusting the speed of the bottom wheel 22 to a point, where the particles are abundantly removed from the bottom space 79 of the chamber.

Every different type of particle form material (or type of seeds) and every different feeding rate requires adjustment as described above. However, once adjusted for a material type and a feeding rate, the machine operates on its own, requiring only sporadical supervision.

Special applications:

It was stated above that a particle's capacity to float in a fluid bed depends on three independent variables: (1) the weight of such particle (or its volume if the particle form material has a substantially constant specific weight); (2) its shape expressed as air resistance produced by such shape; and (3) its specific weight (or its density). Shape and specific weight were so far presumed substantially constant. Following special applications should also be considered:

1) If the particles differ in density, but have a substantially uniform size (volume) and shape, the particles with lower density are suspended in the top channel(s) and are therefore easily separated. If the particles differ in density as well as in size, separation of the seeds of lower density is possible when these particles have either same or smaller size than the material's average particle size. However, the separation is difficult and more unlikely if the particles of lower density are larger than such average size.

2) Split particles normally weigh less and have shapes producing more air resistance, and therefore may be expected to float in the top channel(s) and be easily separated. However, if the split does not alter enough the particle's shape and augment thereby its air resistance, and/or does not reduce enough the particle's weight, separation is difficult and more unlikely.

It will be evident to those skilled in the art that the present invention is not limited to the details of the foregoing preferred embodiment and that the invention may be embodied in other specific forms without departing from the spirit or essential attributes thereof. The described embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An apparatus for cleaning and classifying solid particles having different weights, said apparatus comprising:

a) a vertical chamber having side walls and a cross-sectional area generally increasing in the upward direction, b) means for introducing particles of different weights into the chamber, c) means for creating in the chamber a vertical upward suspension air stream whose velocity varies in a substantially continuous manner with height, to thereby classify particles of different weights and volatilities at different chamber heights; whereby the lighter and more volatile particles are suspended at a height higher than the heavier and less volatile particles, d) a top section provided with outlet means and connected to the top of the vertical chamber to collect and remove particles lighter and more volatile than the particles suspended at the top of the vertical chamber, e) a plurality of at least one channel spaced vertically within the chamber, where particles within a range of similar weights and volatilities are suspended and conveyed horizontally toward channel outlet means arranged vertically along one side wall of the chamber for removing by suction the suspended, classified particles, f) a plurality of at least one ribbed section spaced vertically within the chamber and located adjacently to the channels; wherein a plurality of at least one deviating rib divides each such section in a plurality of pathways and deviates the upward air, to thereby homogenize the vertical velocity horizontally throughout adjacent channels; wherein the air velocity in each pathway has a substantial non-vertical component such that the air resistance to the gravity fall of particles is insufficient; wherein particles falling through the sections are conveyed horizontally toward air extraction means arranged vertically at one end of the ribbed sections along the side wall opposite to the chamber side wall on which the channel-outlet means are positioned, to thereby spread the particles more uniformly horizontally in the direction of length throughout the chamber; whereby at a specified height length is the distance between the side wall on which the air extraction means are positioned and the opposite side wall on which the channel outlet means are located and width is the distance between the other two opposite side walls, g) means to spread the particles horizontally in the direction of width; whereby said means are omitted in special situations where they are not found indispensable for air stability, h) means for creating a horizontal conveyor air stream to direct the particles suspended in the channels toward the respective channel outlet means on one chamber side wall, i) means to create a horizontal conveyor air stream of opposite direction to direct the particles falling through the ribbed sections toward the respective air extraction means on the wall opposite to the chamber side wall on which the channel outlets means are positioned; whereby said means are omitted in special situations where they are not found indispensable for air stability, j) means for the observation of the air streams, the streams of particles and the process in general by any selected from the group consisting of at least one operator and at least one process controlling device, k) means for the adjustment of the streams and the process in general by any selected from the group consisting of at least one operator and at least one process controlling device, and l) means to drive the apparatus.

2. The apparatus according to claim 1, further having the characteristics of an embodiment, wherein the side wall on which the channel outlet means are arranged and the opposite side wall on which the air extraction means are arranged are parallel and wherein the other opposite side walls diverge in upward direction; wherein the top section has generally convergent side walls and accordingly a cross-sectional area generally decreasing in upward direction, as well as four subsections, whereby said subsections converge and are connected at their respective upper regions; wherein the ribbed section has a cross-sectional area at its top substantially equal to the cross-sectional area at its bottom; wherein the plurality of deviating ribs comprises parallel thin zigzag ribs distanced about one inch, to thereby allow the relatively heavy particles which do not become suspended, to fall through the ribbed sections; wherein the plurality of channel outlet means comprises outlet collectors having a downward inclination to facilitate the removal of the classified particles; wherein the plurality of air extraction means comprises air extractions provided with adjustable valves and having an upward inclination, to render more difficult the extraction of particles falling through the ribbed sections; wherein the means for introducing particles of different weights into the chamber is a horizontal air locking wheel for uniformly feeding the particles along substantially the entire top length of the chamber, whereby said wheel is supplied by a vertical hopper located on top and adjacently to the wheel along substantially the entire length of the wheel, said hopper being fed by an elevator through a precleaning screen and a device to spread the particles horizontally within the hopper; wherein the means to spread the particles in the chamber horizontally in the direction of chamber width are means arranged in length, below and adjacently to the air-locking wheel on at least one side wall of the chamber; wherein there are six channels provided with their respective outlet collectors and five ribbed sections provided with their respective air extractions; wherein the means used for the observation of the streams and the process in general by an operator are windows on the chamber side walls; wherein the means to adjust the streams are adjustable valves; wherein the means to drive the unit are electric motors.

3. The apparatus according to claim 1, further including a bottom section provided with outlet means and connected to the bottom of the vertical chamber, to collect and remove relatively heavy particles which do not become supended in the vertical airstream.

4. The apparatus according to claim 3, wherein the means to remove the particles collected at the bottom comprises a horizontal air-locking wheel along substantially the entire length of the chamber.

5. The apparatus according to claim 1, further comprising a plurality of at least one device to process the air removed from the chamber and a plurality of at least one means to connect said devices to the apparatus; whereby said processing devices comprise any devices which separate particles from the air, such as cyclones add other separators.

6. The apparatus according to claim 1, further including means to recycle air removed from the chamber.

7. The apparatus according to claim 1, further including any selected from the group consisting of means to stabilize the air in the chamber, means to homogenize horizontally the chamber's vertical upward air velocity, and means to achieve simultaneously both former objectives.

8. An apparatus according to claim 1, further including a ballistic separator of particles, said ballistic separator comprising:

a) a chamber having top, bottom and side walls, b) means to create an air stream through the chamber, c) a plurality of at least one ballistic inlet fed by a stream of particles conveyed by a stream of air; whereby said inlets are provided with ballistic means for projecting the particles at the inlet horizontally at distance into the chamber and for adjusting the extent of said projection; whereby said inlets are arranged vertically along one side wall of the chamber, d) a vertical divider partition located at a selected distance from said inlets to divide the chamber into two sections, whereby particles projected less than said selected distance land into one section of the chamber and particles projected greater than said selected distance land into the other section of the chamber, to thereby separate the particles into two groups, corresponding to the two sections, e) a plurality of at least one air-extraction means arranged vertically along the side wall opposite to the chamber side wall on which the ballistic inlets are positioned, f) a plurality of at least one inclined inner wall spaced vertically within the chamber, located adjacently to the ballistic inlets, dividing the chamber into a plurality of ballistic channels, extending along substantially the entire length of the chamber and having a sufficiently steep slope to allow the landing particles to fall into a chamber bottom space having outlet means to remove the particles; whereby the length of the chamber is the distance between the side wall on which the ballistic inlets are positioned and the opposite wall on which the air extraction means are located and the width is the distance between the other opposite side walls, g) means for the observation of the air streams, the streams of particles and the process in general by any selected from the group consisting of at least one operator and at least one process controlling device, h) means for the adjustment of the streams and the process in general by any selected from the group consisting of at least one operator and at least one process controlling device, and i) means to drive the apparatus.

9. The apparatus according to claim 8, further including the characteristics of an embodiment, wherein the plurality of ballistic means comprises six pipes having an adjustable rectangular cross-section allowing to adjust different extents for the projections, and an adjustable pivoting gate on top of the inlet to select from the group consisting of gate adjustments which, by deviating the stream of particles downward, limit the extents of the projections to less than said distance of the vertical divider partition, and gate adjustments which allow the projections to extend beyond such distance; wherein the plurality of air-extraction means comprises six air-extractions provided with adjustable valves and having an upward inclination, to render more difficult the extraction of particles being projected within the ballistic channels; wherein the means to remove particles collected at the bottom comprises a horizontal air-locking wheel along substantially the entire length of the chamber; wherein the means for observation of the streams and the process in general by an operator comprise windows on two side walls and a door on one side wall to introduce and remove sampling boxes which are placed within the ballistic channels.

10. The apparatus according to claim 8, further including means for the horizontal adjustment of the the position of the vertical divider partition along the ballistic chamber by any selected from the group consisting of at least one operator and at least one process controlling device.

11. A method for cleaning and classifying solid particles having different weights, said method comprising:

a) introducing the particles of different weights into a vertical chamber; whereby said chamber has side walls and a cross-sectional area generally increasing in the upward direction, b) creating in the chamber a vertically upward air stream whose velocity varies in a substantially continuous way with height, to thereby suspend such particles of different weights and volatilities at different respective vertical heights; whereby the lighter and more volatile particles are suspended at a height higher than the heavier and less volatile particles; whereby said vertical chamber has a top section provided with outlet means and connected to the top of the chamber for collection and removal of particles lighter and more volatile than the particles suspended at the top of the chamber, c) creating a horizontal conveyor air stream in a plurality of at least one channel spaced vertically within the chamber, wherein particles within a range of similar weights and volatilities are suspended, to thereby convey such suspended, classified particles toward channel outlet means arranged vertically along one side wall of the chamber and thereat remove the particles by suction, d) creating an opposite horizontal conveyor air stream in a plurality of at least one ribbed section spaced vertically within the chamber and located adjacently to the channels to convey horizontally the particles falling through the ribbed sections toward air extraction means arranged vertically at one end of the ribbed sections along the side wall opposite to the chamber side wall on which the channel outlet means are positioned, to thereby spread the particles more uniformly in the direction of length throughout the chamber; whereby a plurality of at least one deviating rib divides each section in a plurality of pathways and deviates the upward air, to thereby homogenize the vertical upward velocity horizontally throughout the adjacent channels; whereby the air velocity in each pathway has a substantial non-vertical component such that the air resistance to the gravity fall of the particles is insufficient; whereby at a specified height length is the distance between the side wall on which said air extraction means are positioned and the opposite side wall on which the channel outlet means are located and width is the distance between the other opposite side walls; whereby said opposite horizontal conveyor air stream is omitted in special situations where it is not found indispensable for air stability, e) spreading the particles horizontally in the direction of width; whereby such spreading is omitted in special situations where it is not found indispensable for air stability, f) having means used for the observation of the air streams, the streams of particles and the process in general by any selected from the group consisting of at least one operator and at least one process controlling device, g) having means used for the adjustment of the air streams, the streams of particles and the process in general by any selected from the group consisting of at least one operator and at least one process controlling device, and h) having means used to drive the unit.

12. The method according to claim 11, further including using means to collect and remove the relatively heavy particles which do not become suspended in the vertical air stream and fall through toward the bottom of the chamber by means of a bottom section provided with outlet means.

13. The method according to claim 11, further including using a plurality of at least one device to process the air removed from the chamber and a plurality of at least one means to connect such devices to the apparatus in claim 1; whereby said processing comprises any methods, wherewith particles are separated from the air, such as the methods of cyclones and other separators.

14. The method according to claim 11, further comprising recycling air removed from the chamber.

15. The method according to claim 11, further including using any selected from the group consisting of means to stabilize the air in the chamber, means to homogenize horizontally the chamber's vertical upward velocity and means to achieve both former objectives simultaneously.

16. The method according to claim 11, further including a ballistic method for separating the particles, said ballistic method comprising:

a) creating an air stream through a ballistic chamber having top, bottom and side walls, b) separating the particles in said chamber by receiving each of a plurality of at least one stream of particles conveyed by a stream of air through a corresponding inlet in a plurality of at least one inlet provided with ballistic means to project the particles horizontally into one of two sections of the chamber depending on the adjustable extent of horizontal projection, said inlets being arranged vertically along one side wall of the chamber; whereby the ballistic chamber has a vertical divider partition located at a selected distance from said inlets to divide the chamber into two sections; whereby particles projected less than said selected distance land into one section of the chamber and particles projected greater than said selected distance land into the other section of the chamber, to thereby separate the particles into two groups, corresponding to the two sections; whereby air is extracted at a plurality of at least one air extraction means arranged vertically on the side wall opposite to the chamber side wall on which the ballistic inlets are positioned; whereby a plurality of at least one inclined inner wall spaced vertically within the chamber and located adjacently to the ballistic inlets, extending along substantially the entire length of the chamber and dividing the chamber into a plurality of ballistic channels, has a substantially steep slope to allow the landing particles to fall into a chamber bottom space having outlet means to remove the particles; whereby the length of the chamber is the distance between the side wall on which the ballistic inlets are positioned and the opposite side wall on which the air extraction means are located and the width is the distance between the other opposite side walls, c) removing the particles in the chamber bottom space through outlet means, d) having means used for the observation of the air streams, the streams of particles and the process in general by any selected from the group consisting of at least one operator and at least one process controlling device, e) having means used for the adjustment of the air streams, the streams of particles and the process in general by any selected from the group consisting of at least one operator and at least one process controlling device, and f) having means used to drive the unit.

17. The method according to claim 16, further including having means used for the horizontal adjustment of the position of the vertical divider partition along the ballistic chamber by any selected from the group consisting of at least one operator and at least one process controlling device.

* * * * *